United States Patent [19]

Dubeck et al.

[11] 3,984,237

[45] Oct. 5, 1976

[54] LEACHING OF LOW-GRADE NICKEL COMPLEX ORE

[75] Inventors: Michael Dubeck, Birmingham; Suk Joong Im, Southfield, both of Mich.

[73] Assignee: Ethyl Corporation, Richmond, Va.

[22] Filed: Mar. 27, 1975

[21] Appl. No.: 562,477

[52] U.S. Cl. ..... 75/103; 75/101 R; 75/119; 423/150

[51] Int. Cl.[2] ..... C22B 23/04

[58] Field of Search ..... 75/119, 103, 101 R; 423/150

[56] References Cited

UNITED STATES PATENTS

| | | | |
|---|---|---|---|
| 1,891,532 | 12/1932 | Gibson | 75/103 |
| 2,928,732 | 3/1960 | Bare et al. | 75/119 |
| 3,644,114 | 2/1972 | Vosahlova et al. | 75/101 R |
| 3,728,105 | 4/1973 | Skarbo | 75/103 |
| 3,896,208 | 7/1975 | Dubeck et al. | 423/150 |

*Primary Examiner*—G. Ozaki

*Attorney, Agent, or Firm*—Donald L. Johnson; John F. Sieberth; Robert A. Linn

[57] ABSTRACT

A process for extracting nickel from a low-grade nickel complex ore. The process features leaching the ore under elevated temperatures for relatively short periods of time with an aqueous ammoniacal leach solution.

8 Claims, No Drawings

LEACHING OF LOW-GRADE NICKEL COMPLEX ORE

BACKGROUND OF THE INVENTION

The subject matter of the present invention is the recovery of nickel values from a low-grade nickel complex ore. The recovery comprises the leaching, under elevated temperatures, of the ore with an aqueous ammoniacal solution for relatively short, preferably about an hour or less, periods of time.

Commercially significant nickel deposits are of two main types: (i) sulphides which are primary nickel ores or rock materials and (ii) laterites and garnierites which are secondary nickel ores or rock materials. The nickel bearing laterites and garnierites result from the deterioration of primary rock materials through weathering, erosion and related chemical and physical processes during which the nickel values are greatly concentrated compared with the primary rock materials and are deposited in layers of altered residual rock materials. These nickel bearing laterites and garnierites normally contain from about 1.5 to about 3 weight percent nickel.

Primary rock materials with a low nickel content, typically below 0.5 weight percent, are found in various Precambrian and Cordillera regions in Alaska, Asia, Australia, Canada, Northern Europe and in various tropical and subtropical regions. In Canada the low-grade primary nickel ores are characteristically found in the form of peridotite or other ultramafic rock formations. These formations represent huge reserves of nickel. However, due to the low nickel values of these ores it is difficult to extract the nickel on a commercially viable basis. Several techniques have been used in attempting to extract the nickel from said ores commercially. These methods include various flotation, magnetic separation, and roast-leach processes. However, these techniques have not proved to be entirely satisfactory, either because of rather high costs or because of rather small amounts of nickel extracted.

The present invention resides in the discovery that in a high temperature leach of the low-grade nickel ore the maximum solubilization of nickel in the leach solution occurred within a matter of minutes after leaching began and thereafter decreased dramatically with increased leaching time. This is in sharp contrast to known leaching techniques wherein the amount of nickel extracted into the leach solution increases with the increase in length of time that leaching is carried out. Past practice has been to leach the ore for at least 24 hours, and often for periods of up to several days and even weeks.

SUMMARY OF THE INVENTION

A process for extracting nickel from a low-grade nickel complex ore by leaching said ore with an aqueous ammoniacal solution under elevated temperatures for relatively short periods of time whereby increased solubilization of nickel values in the leach solution is obtained.

DESCRIPTION OF THE PREFERRED EMBODMENTS

An embodiment of the present invention is a process for recovering an increased quantity of nickel values from a low-grade complex nickel ore, said process comprising leaching at elevated temperatures a comminuted nickel ore characterized by having a S:Ni ratio of less than 1 with an aqueous solution of ammonia and ammonium salt for a time (1) sufficient to form a resultant aqueous solution of nickel values and (2) insufficient to allow a significant amount of diminishment of recoverable nickel values from said resultant solution. By recoverable nickel values is meant those nickel values which can be readily extracted or obtained from the leach solution with presently known techniques such as ion exchange, precipitation and the like.

In a preferred embodiment of the present invention the process comprises leaching at elevated temperatures a comminuted nickel ore characterized by having a S:Ni ratio of 1 or less than 1 and a nickel content of less than about 0.5% with an aqueous ammonia and ammonium salt solution, said solution additionally containing an amount of $SO_3^{--}$ or $CO_3^{--}$ sufficient to enhance Ni leaching, for a time (1) sufficient to form a resultant aqueous solution of nickel values and (2) insufficient to allow a significant amount of diminishment of recoverable nickel values from said resultant solution.

The native low-grade nickel ores vary some both in physical characteristics and chemical compositions depending on the region the ore is obtained. Typically, these ores contain nickel as sulphides, oxides, silicates, alloys, and to a minor degree arsenides. In general, the nickel sulphide minerals are primarily millerite and pentlandite, but also may include siegenite, violarite, heazlewoodite, polydymite and gersdorfite. These ores may also contain iron-nickel alloys such as awaurite. Other minerals commonly found in such peridotite ores are serpentine, talc, magnetite, dolomite, brucite, and chromite. The nickel content of such peridotite ores generally falls below 0.5 weight percent, usually from about 0.2 to about 0.4 weight percent.

These peridotite ores also have large silicon and magnesium contents and very low sulphur, low iron (1 to 10% by weight) and low copper contents. These ores are further characterized by having a low sulphur to nickel weight ratio, generally 1 or less than one. The results of an analysis of a sample of peridotite ore from Canada are set forth below in Table I in percent by weight.

Table I

| | | |
|---|---|---|
| % Nickel | Ni | 0.38 |
| % Sulphur | S | 0.09 |
| % Silica | $SiO_2$ | 34.64 |
| % Iron | Fe | 5.30 |
| % Alumina | $Al_2O_3$ | 0.51 |
| % Lime | CaO | 0.03 |
| % Magnesia | MgO | 40.86 |

In contrast to these low-grade nickel peridotite ores which generally have a nickel content of from about 0.2 to about 0.4% by weight, the nickel-bearing laterites which are normally the ores of choice for commercial exploitation contain from 1.5 to 3% by weight nickel.

In accordance with the present invention the low-grade nickel complex ore is first pulverized and ground in a conventional grinder to a small particle size, as from about 35 mesh to about 200 mesh, preferably in the range of about 200 mesh. The ground ore is then introduced into a closed vessel, such as an autoclave, and leached at elevated temperatures with an aqueous ammoniacal solution.

The aqueous ammoniacal solution, which can be a typical leach solution known in the art, contains ammonia/ammonium salts. In a preferred embodiment of the present invention the ammonia/ammonium salt solution can contain sulfite ions, or carbonate ions, or sulfate ions. Thus a preferred aqueous, ammoniacal leach solution will contain ammonia and $SO_3^{--}$. Another preferred aqueous ammoniacal leach solution will contain ammonia and $CO_3^{--}$. Still another preferred aqueous ammoniacal leach solution will contain ammonia and $SO_4^{--}$.

The amounts of $SO_3^{--}$ or $CO_3^{--}$ in the leach solutions defined above can be provided by introducing $SO_2$ or $CO_2$ gas into the ammoniacal solution. Alternatively, and preferably, the equivalent amounts of $SO_3^{--}$ and $CO_3^{--}$ are introduced into the solution as soluble salts, e.g., of ammonia or sodium. Preferably the $SO_3^{--}$ is introduced as ammmonium sulfite, while the carbonate ion is preferably introduced into the solution as ammonium carbonate. Mixtures of gas and salt can also be used as for example a mixture of $CO_2$ and ammonium carbonate or $SO_2$ and ammonium sulfite. As for sulfate ion, it is also introduced into the leach solution as a water soluble salt, preferably as ammonium sulfate. The ammonia is preferably introduced as an aqueous solution of ammonia and water, although it can be introduced as $NH_3$ gas, as a water-containing ammonium salt, or as aqueous ammonium hydroxide.

The ammonium salt of the present invention are the chloride, carbonate, sulfate, phosphate, bromide, iodide, phosphite, sulfite, cyanide, fluoride, sulfide, and the like, including mixtures thereof.

When $SO_3^{--}$ is present in the leach solution, it is preferred that the concentration be at least about 5 grams of sulfite per liter of solution. A preferred concentration of sulfite is at least about 10 grams of sulfite per liter of solution. A more preferred concentration of sulfite is at least about 50 grams of sulfite per liter of leach solution. The most preferred concentration of sulfite is at least about 75 grams per liter. Although the most preferred concentration range of sulfite is from about 75 to about 100 grams per liter, there is no real upper limit on the concentration of the sulfite. Instead, the upper limit is determined by such secondary considerations as solubility of the sulfite in the leach solution, economics and convenience.

When carbonate is present in the leach solution, it is preferred that the concentration be at least about 5 grams of carbonate per liter of leach solution. A preferred concentration of carbonate is at least about 25 grams of carbonate per liter. A more preferred concentration of carbonate is at least about 50 grams of carbonate per liter with a most preferred concentration of carbonate being about 75 grams of carbonate per liter. The most preferred concentration range of $CO_3^{--}$ is from about 75 to about 100 grams per liter. There is no real upper limit on the carbonate concentration and the upper limit is, therefore, determined by such secondary considerations as solubility of carbonate in the solution, economics and convenience.

The sulfate ion is preferably provided as ammonium sulfate, although it can be introduced into the leach solution in the form of other water soluble salts or as sulfuric acid. When sulfate is present in the leach solution, it is preferred that the concentration be at least about 10 grams of sulfate per liter of leach solution. A preferred concentration of sulfate is at least about 50 grams of sulfate per liter of solution. A more preferred concentration of sulfate is at least about 100 grams of sulfate per liter of solution. The most preferred concentration of sulfate is at least about 150 grams of sulfate per liter with the most preferred concentration range being from about 150 to about 200 grams per liter. There is no real upper limit on the sulfate concentration, and, therefore, the upper limit is controlled by such secondary factors as solubility of the sulfate in the leach solution, economics, and the like.

For purposes of this invention, the concentration of the $NH_3$ in the leach solution is generally at least about 10 grams of $NH_3$ per liter of leach solution. A preferred concentration is at least about 50 grams of $NH_3$ per liter of leach solution. A more preferred concentration is at least about 100 grams of $NH_3$ per liter of solution with a most preferred concentration being at least about 125 grams of $NH_3$ per liter of leach solution. While the most preferred concentration range of ammonia in the leach solution is from about 125 to about 200 grams of $NH_3$ per liter of leach solution, it is to be understood that there is no upper limit on the $NH_3$ concentration. Thus, the upper limit of the $NH_3$ concentration is established by such secondary characteristics as availability of $NH_3$, convenience, economics, and the like.

The leaching process is preferably carried out at from about 5 to about 65%, by weight, solid loading; that is, in a slurry which contains from about 5 solids and 95% liquor to one which contains 65% solid and 35% liquor. A more preferred slurry contains from about 7% to about 60% solid loading. A most preferred slurry contains from about 10% to about 50% solid loading.

The leaching process need not be conducted under superatmospheric pressure. However, if $CO_2$ or $SO_2$ gas is used the process is conducted in a closed vessel. Therefore, because of the closed nature of the leaching apparatus and the high temperatures that are used, superatmospheric pressures result. These pressures that develop are usually above about 50 psia. Additionally, if desired, the leaching can be conducted under superatmospheric pressures by adding nitrogen or similar gases. These pressures preferably are greater than 50 psia and usually greater than 100 psia. There is no real upper limit on the pressure and, accordingly, the upper limit is restricted by such secondary considerations as design of the reaction vessel, economics, etc. In general, the process can be conducted at pressures up to 5000 or more, preferably, up to 2500 psia.

The reaction, or leaching process, is both temperature and time dependent. Generally, the best results are obtained if the process is conducted at temperatures elevated above ambient. Temperatures within the range of from about 80°C. to about 325°C. can be used. Higher and slightly lower temperatures can also be used. A preferred range of temperatures is from about 100°C. to about 300°C. A more preferred range of temperatures is from about 100°C. to about 275°C. A most preferred range of temperatures is from about 100°C. to about 250°C.

The reaction, or leaching, time in this process is critical. The leaching time, that is the time during which the leaching solution is in contact and reacting with the ore, should be sufficient to form a resultant aqueous solution of increased nickel values, but insufficient to allow a significant amount of diminishment of recoverable nickel values from the resultant solution. This period, which is to a degree temperature dependent, is generally under three hours, and should preferably be under 60 minutes, i.e., from about one minute to about 60 minutes, more preferably in the range of from about five to about 30 minutes, and most preferably in the range of from about 10 to about 15 minutes. While not desiring to be limited to any particular theory or mechanism of reaction, it is believed that the nickel which is solubilized into the leach solution settles out or precipitates from said leach solution after a period of time. As the leaching time progresses the recoverable nickel values in the solution increase, go through a maximum, and then start to decline. The rate of increase of nickel values, the time to reach maximum or near maximum values, the length of time during which the nickel values remain at or near maximum, and the rate of decline of the nickel values are all dependent on the temperature at which leaching is carried out. Generally the higher the leaching temperature the greater the rate of increase of nickel values, the shorter the time to reach maximum or near maximum values, the shorter the time period during which the nickel values in solution are at or near maximum in a recoverable state and the quicker the rate of decline of recoverable nickel values in solution. Thus, it is important to stop the leaching reaction, as by cooling the reaction vessel, when the amount of nickel therein is not diminished to any untoward extent, more preferably when the amount of recoverable solubilized nickel is at or near a maximum. Thus, for best results, that is to extract the maximum amount of nickel from the ore, it is important to separate the leach solution from the ore residue when the amount of solubilized nickel therein (in the solution) is at or near a maximum. Since the amount of solubilized nickel present in the leach solution is dependent to a great extent upon temperature and time, the leaching time and temperature become critical. Thus, the higher the temperature the shorter the leach time to prevent redeposition of nickel. This importance in leaching time is demonstrated in the data presented in Table II below.

GENERAL PROCEDURE

From about 20 to about 30 grams of low-grade nickel complex ore described above ground to about 200 mesh, are charged to a closed vessel such as an autoclave. To the autoclave is added about 100 cc of aqueous ammoniacal leach solution. The autoclave is then pressurized with an initial pressure of $N_2$ of from about 50 psia to about 200 psia. Although in the present series of examples $N_2$ was used, it is to be understood that other gases, or mixtures of gases, can also be used. After the pressurization with $N_2$ the vessel, in this case an autoclave, is heated to a temperature in the range of from about 100°C. to about 250°C. After a few minutes the autoclave is cooled, as by quenching with water, and depressurized, the leached mixture is filtered and the filtrate is analyzed for nickel content.

Following is a tabulation of data for a series of examples leached according to the aforementioned procedure. While the actual species in solution are $SO_3^{--}$ and $CO_3^{--}$, the concentrations in Table II are given in terms of equivalents of $SO_2$ or $CO_2$. By an equivalent of $SO_2$ or $CO_2$ is meant that amount of $SO_2$ or $CO_2$ which will product an equivalent amount by weight of $SO_3^{--}$ or $CO_3^{--}$ respectively.

Table II

| Ex. | Leaching Agent (g/l) | Temp. °C. | Time (Minutes) | % Ni Extraction |
|---|---|---|---|---|
| 1 | 172 $NH_3$ | 250 | 10 | 81.0 |

Table II-continued

| Ex. | Leaching Agent (g/l) | Temp. °C. | Time (Minutes) | % Ni Extraction |
|---|---|---|---|---|
| | 90 $SO_2$ | 250 | 15 | 9.1 |
| | | 250 | 60 | 0.8 |
| | | 250 | 180 | 0.0 |
| 2 | 172 $NH_3$ | 200 | 10 | 83.0 |
| | 90 $SO_2$ | 250 | 15 | 77.0 |
| 3 | 80 $NH_3$ | 250 | 15 | 5.1 |
| | 100 $SO_2$ | 250 | 30 | 1.5 |
| | | 250 | 60 | 0.0 |
| | | 250 | 180 | 0.0 |
| 4 | 100 $NH_3$ | 200 | 10 | 27.0 |
| | 90 $SO_3$ | 250 | 15 | 10.0 |
| | | 250 | 30 | 3.6 |
| | | 250 | 60 | 2.0 |
| | | 250 | 180 | 0.0 |
| 5 | 100 $NH_3$ | 200 | 10 | 32.5 |
| | 90 $SO_3$ | 250 | 15 | 10.0 |
| | | 250 | 30 | 3.8 |
| | | 250 | 60 | 1.8 |
| | | 250 | 180 | 0.0 |
| 6 | 165 $NH_3$ | 200 | 10 | 37.5 |
| | 90 $SO_3$ | 250 | 15 | 17.0 |
| | | 250 | 30 | 8.0 |
| | | 250 | 60 | 5.0 |
| | | 250 | 180 | 2.0 |
| 7 | 165 $NH_3$ | 120 | 5 | 42.0 |
| | 90 $SO_3$ | 150 | 12 | 50.0 |
| | | 200 | 15 | 60.5 |
| | | 200 | 30 | 62.8 |
| | | 200 | 60 | 48.4 |
| 8 | 165 $NH_3$ | 200 | 12 | 60.0 |
| | 90 $SO_3$ | 220 | 15 | 66.0 |
| | | 220 | 30 | 61.0 |
| | | 220 | 60 | 34.5 |
| 9 | 200 $NH_3$ | 200 | 15 | 66.0 |
| | 100 $SO_3$ | 220 | 20 | 61.0 |
| | | 220 | 60 | 34.5 |
| 10 | 100 $NH_3$ | 200 | 10 | 26.0 |
| | 50 $CO_2$ | 250 | 15 | 12.0 |
| | | 250 | 30 | 10.0 |
| | | 250 | 60 | 3.6 |
| | | 250 | 180 | 0.0 |
| 11 | 172 $NH_3$ | 150 | 10 | 82.0 |
| | 90 $SO_2$ | 180 | 15 | 85.0 |
| | | 200 | 20 | 85.0 |
| | | 200 | 30 | 84.0 |
| | | 200 | 60 | 80.0 |
| 12 | 172 $NH_3$ | 100 | 10 | 65.5 |
| | 90 $SO_2$ | 100 | 30 | 77.8 |
| | | 100 | 60 | 81.0 |
| | | 100 | 180 | 75.0 |
| 13 | 129 $NH_3$ | 150 | 10 | 75.0 |
| | 67.7 $SO_2$ | 180 | 15 | 76.0 |
| | | 205 | 20 | 79.0 |
| | | 203 | 30 | 79.0 |
| 14 | 86 $NH_3$ | 150 | 10 | 61.0 |
| | 45 $SO_2$ | 200 | 20 | 31.0 |
| | | 200 | 30 | 24.0 |
| 15 | 200 $NH_3$ | 150 | 10 | 50.2 |
| | 10 $SO_2$ | 180 | 15 | 58.4 |
| | | 200 | 20 | 59.0 |
| | | 200 | 60 | 32.0 |
| 16 | 100 $NH_3$ | 200 | 10 | 26.0 |
| | 50 $CO_2$ | 250 | 15 | 12.0 |
| | | 250 | 30 | 10.0 |
| 17 | 200 $NH_3$ | 150 | 10 | 46.0 |
| | 50 $CO_2$ | 180 | 15 | 26.0 |
| | | 200 | 20 | 21.0 |
| | | 200 | 60 | 18.0 |
| 18 | 200 $NH_3$ | 120 | 10 | 44.0 |
| | 50 $CO_2$ | 150 | 15 | 48.0 |
| | | 150 | 20 | 48.0 |
| | | 150 | 60 | 46.0 |

From the data in Table II, it is clear that lowering the temperature at which leaching is carried out prolongs the time during which the nickel values remain at or near a maximum in the leach solution. Raising the temperature, on the other hand, results in the nickel values in the leach solution reaching a maximum in shorter leaching time and remaining at or near the maximum value a shorter period of time before beginning to decline.

Because of this it is preferred that the leaching process be halted quickly once the desired concentration of nickel values in the solution is obtained. This done by quickly cooling the vessel in which leaching is occurring, as by quenching with water. The higher the temperature, and, therefore, the shorter the time period during which the nickel values in the solution are at or near a maximum before they start to redeposit, the quicker should be the cooling. Preferably, the leach system is cooled below about 100°C. More preferably the leach system is cooled below about 80°C. Most preferably the system is cooled to ambient or room temperatures. Furthermore, the nickel values decline much more rapidly at these higher temperatures than at lower temperatures. From an economic standpoint, it is much more advantageous to be able to obtain maximum nickel extraction in the shortest period of time. The data in Table II also shows that an ammonia and sulfite leach system results in a greater, over 80 percent, extraction of nickel values than either an ammonia and carbonate or ammonia and sulfate system.

The amount of recoverable nickel values solubilized into the leach solution is also dependent upon the concentration of $NH_3$, $CO_2$ or $SO_2$ in the leach solution. Thus, for example, increasing the concentration of $NH_3$ in the leach solution increases the solubilization of nickel into the leach solution at a given temperature. Likewise, increasing the concentration of $CO_2$ or $SO_2$ in the leach solution results in an increase of recoverable nickel values in the leach solution at a given temperature.

Claims to the invention follow.

We claim:

1. A process for recovering an increased quantity of nickel values from a low-grade nickel complex ore, said process comprising leaching at elevated temperatures a comminuted nickel ore characterized by having a sulfur to nickel weight ratio of less than 1 and a nickel content of less than 0.5 percent by weight with an aqueous solution of ammonia and ammonium salt for a period of time (1) sufficient to form a resultant aqueous solution of increased nickel values but (2) insufficient to allow a significant amount of diminishment of recoverable nickel values from said resultant solution.

2. The process of claim 1 wherein said solution of ammonia and ammonium salt additionally contains an amount of sulfite or carbonate ions sufficient to enhance nickel leaching.

3. The process of claim 2 wherein said time is from about one minute to about three hours.

4. The process of claim 3 wherein said temperatures are from about 100°C. to about 250°C.

5. The process of claim 4 wherein leaching is carried out at superatmospheric pressures.

6. The process of claim 5 wherein leaching is carried out under nitrogen pressure.

7. The process of claim 4 wherein said temperature is from about 200°C. to about 250°C. and said time is from about 5 minutes to about 60 minutes.

8. The process of claim 7 wherein said temperature is about 250°C. and said time is from 5 minutes to about 30 minutes.

* * * * *